US006767189B2

(12) United States Patent
Kleibrink

(10) Patent No.: US 6,767,189 B2
(45) Date of Patent: Jul. 27, 2004

(54) METHOD FOR THE CONTROL AND REGULATION OF THE OIL PRESSURE-GAS PRESSURE RELATIONSHIP OF DIAPHRAGM COMPRESSORS

(76) Inventor: Horst Kleibrink, Heisenbergstr. 16, 45473 Muelheim-Rhur (DE)

( * ) Notice: Subject to any disclaimer, the term of this patent is extended or adjusted under 35 U.S.C. 154(b) by 48 days.

(21) Appl. No.: 10/211,764

(22) Filed: Aug. 2, 2002

(65) Prior Publication Data

US 2003/0031565 A1 Feb. 13, 2003

(30) Foreign Application Priority Data

Aug. 7, 2001 (DE) ..... 101 38 674

(51) Int. Cl.[7] ..... F04B 143/06

(52) U.S. Cl. ..... 417/53; 417/383; 417/385; 417/388; 417/395

(58) Field of Search ..... 417/53, 383, 385, 417/388, 395

(56) References Cited

U.S. PATENT DOCUMENTS 5,249,932 A * 10/1993 Van Bork ..... 417/386
5,516,429 A * 5/1996 Snodgrass et al. ..... 210/767
6,554,578 B1 * 4/2003 Siegel ..... 417/53
6,574,960 B2 * 6/2003 Kleibrink ..... 60/592

* cited by examiner

*Primary Examiner*—Justine R. Yu
*Assistant Examiner*—Michael K. Gray
(74) *Attorney, Agent, or Firm*—McCormick, Paulding & Huber LLP

(57) ABSTRACT

A method for the control and regulation of the oil pressure-gas pressure relationship of diaphragm compressors.

The function of a diaphragm compressor is mainly dependent on a given minimum relationship of gas pressure and oil pressure. When this is undershot a large direct damage or long term damage can result. Also there exists operating conditions with very different gas pressures for which the maintenance of a given predetermined relationship between gas pressure and oil pressure is of large advantage.

The solution of the invention lies in the capture of the oil pressure-gas pressure relationship with an electronic pressure sensor on the oil side of the diaphragm head and another electronic pressure sensor on the gas outlet side of the diaphragm head, with an associated electronic evaluation circuit for both of the signals for determining from those signals the relationship of the two pressures as well as for producing a signal output upon the undershooting of a given minimum relationship. Further, in the control and regulation of the oil pressure-gas pressure relationship for maintaining a given relationship of oil pressure and a variable gas pressure, which gas pressure is controlled and regulated by the electronic evaluation circuit, an associated relief mechanism of the oil overflow valve is controlled by the electronic evaluation circuit.

11 Claims, 4 Drawing Sheets

METHOD FOR THE CONTROL AND REGULATION OF THE OIL PRESSURE-GAS PRESSURE RELATIONSHIP OF DIAPHRAGM COMPRESSORS

CROSS REFERENCE TO RELATED APPLICATION

Applicant hereby claims foreign priority under 35 U.S.C. § 119 from German Application No. 101 38 674.5 filed Aug. 7, 2001.

FIELD OF THE INVENTION

The invention concerns a method for the control and regulation of the oil pressure-gas pressure relationship of diaphragm compressors.

BACKGROUND OF THE INVENTION

Diaphragm compressors operate similarly to normal piston compressors, but with a separating diaphragm between the gas side and the oil side. The oil side is formed by the usual piston-cylinder unit, whose working and dead volumes are filled with oil. On the gas side are gas suction and pressure valves. The volume displaced by the oscillating movement of the piston is transmitted to the diaphragm, which then on its gas side takes on the suction, the compression and the exhaust of the gases. Since the oil pressure during the entire reciprocating movement corresponds to the course of the suction and compression pressure in the gas side, one can here also talk in terms of the operating mode of a piston compressor.

A small difference to piston compressors exists however in that in the case of diaphragm compressors a secondary oil circuit must be installed to allow compensation for the leakage of oil. For this purpose a compensation pump, driven by an eccentric on the crank shaft is used. This in synchronism with each piston stroke sprays a small amount of oil into the oil space of the compressor.

This amount must theoretically be exactly so large as the leakage at the compressor piston. Since this cannot be technically realized, always an injected amount of oil is used which is larger than the leakage. This in turn has the result that with each stroke of the compressor piston somewhat too much oil is contained in the oil space, which then at the forward dead point of the diaphragm (=engaging the cover), leads to an uncontrollable increase in oil pressure. To prevent this, it is further necessary that an oil overflow valve be used, which limits the oil pressure at the forward dead point of the piston to a value which is slightly above the maximum pressure of the gas.

The relationship between the gas pressure and the oil pressure at the forward dead point established by the oil overflow valve is the most important functional interrelationship in a diaphragm compressor. The reliable functioning of a diaphragm compressor is only achieved if the oil pressure at the forward dead point is always higher than the gas pressure. If this is not the case, the operating area of the diaphragm constantly wanders further toward the area of the aperture plate curve. If the diaphragm indeed touches the aperture plate, because of the given surface relationship, a fast rise in oil pressure occurs, which can lead to the lifting of the cover. Further, high loading peaks occur with very steep flanks which are transmitted to the crank shaft drive mechanism. The cavitation development produced thereby has a negative effect on the service life of the diaphragm.

Therefore, the control and regulation of the relationship between the gas pressure and the oil pressure, established by the oil overflow valve, comes to have a great significance.

Because of the rapid pressure change corresponding to the rotational speed of the compressor, the oil pressure spikes first of late have been able to be captured by some few SPS-controls. These values are then compared with fixed given boundary values, whereupon then in the case of a negative comparison result the compressor is turned off. In this case however only the absolute value of the oil pressure is compared with a shut-off value and not its relation to the momentary gas pressure. The sensing of the relationship is also important insofar as one cannot view the gas pressure as being of constant magnitude, and instead this pressure in the case of an engagement disorder can move into forbidden high areas, or, as can yet more often appear, with the failure of a compressor valve the gas pressure at an intermediate stage can become greatly increased and get into the range of the oil pressure spikes. This damage possibility cannot be controlled by the rigid supervision of the oil pressure absolute value.

Further, an old construction is known in which the gas pressure directly works as a spring supplemental tension force from above onto the spring plate of the oil overflow valve through a small piston. In this case, the spring in its fundamental position is only so pretensioned that it can be uncovered by about 30% of the maximum gas pressure. Further pretensioning results then by way of the gas pressure occurring in the system. The inadequacies of this system lie in the friction of the piston seal at high gas pressures and in the corrosion which can cause a total seizing of the small piston. Further the system is too slow to be able to follow rapid gas pressure increases during the starting phase of a compressor.

The effects on the compressor are fatal in the event they lead to one of the described disturbances in the control piston drive. Therefore, it comes to the situation that it cannot be allowed that the oil pressure suddenly comes to lie in the gas pressure area for even the shortest amounts of time, for within seconds from the engagement of the diaphragm work area with the aperture plate the feared damage occurs.

SUMMARY OF THE INVENTION

The object of the invention is to provide a method whereby the control of a given minimum relationship between gas pressure and oil pressure is assured and in a further construction stage a given relationship value is regulatable by a regulating circuit.

The object is solved by the sensing of the oil pressure-gas pressure relationship with one electronic pressure sensor on the oil side of the diaphragm head and another electronic pressure sensor in the pressurized gas conductor on the gas discharge side of the diaphragm head, with an associated electronic evaluation of both signals to thereby obtain the relationship of the two pressures, as well as by the production of a signal upon the falling of the relationship below a given minimum relationship value, and further by the possibility of maintaining a given relationship of oil pressure and a variable gas pressure controlled and regulated by the electronic evaluation and by a relief mechanism of the oil overflow valve controlled by this electronic evaluation.

The invention is illustrated in the drawings and is hereinafter described in greater detail.

Figure 1:
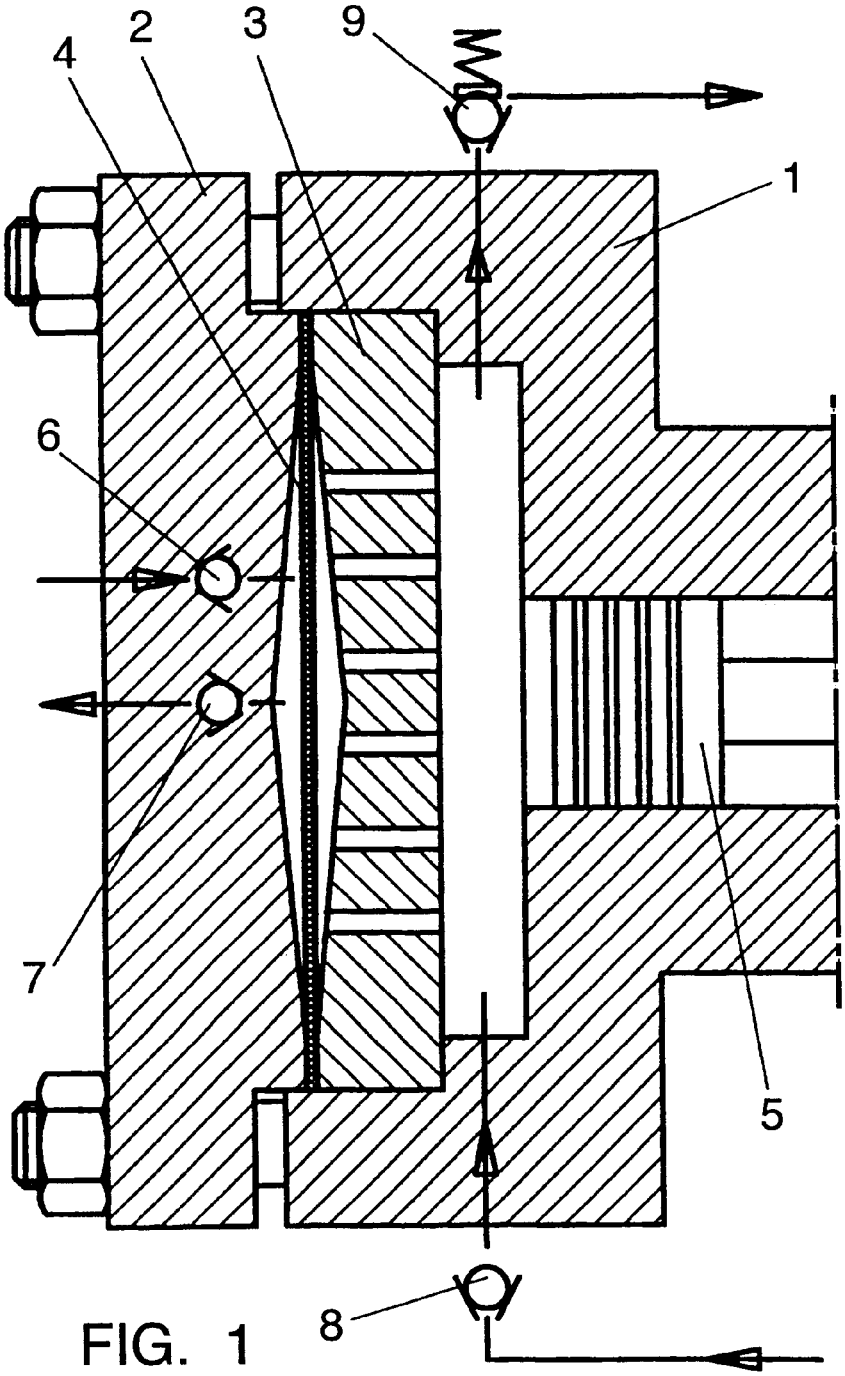
FIG. 1 PRIOR ART
FIG. 1 shows a complete diaphragm head in a construction according to the state of the art.

The principal components of a diaphragm compressor according to FIG. 1 include a flange with a cylinder (1), a cover (2), an aperture plate (3), a diaphragm (4), a piston (5), a suction valve (7), a pressure valve (6), a check valve (8), and an overflow valve (9). The volume designated as the oil space extends between the piston (5) and the diaphragm (4). The volume designated as the gas space extends from the diaphragm (4) to the cover (2). The diaphragm displacement volume is tuned to the piston displacement volume (surface area×stroke), so that the effectiveness of a piston compressor exists. The diaphragm moves in volume synchronism with the piston, sucks in the gas through the suction valve (7), compresses it and pushes it out through the pressure valve (6). The diaphragm displacement volume is always chosen to be somewhat larger than the piston displacement volume.

The leakage of oil at the piston (5) must be compensated for by an external pump. For this, a small piston pump driven by an eccentric is used, which pump with each stroke injects a small amount of oil into the oil space through the check valve (8). Therefore, since the eccentric seats directly onto the crank shaft there occurs in synchronism with each stroke of the main piston (5) an accurately dosed injection by the compensation pump. Since this injected amount of oil for the purpose of operating reliability must be larger than the leakage at the piston (5), an overflow valve (9) is also required, which allows the excessive amount of injected oil to flow out at the forward dead point of the piston (5) and diaphragm (4). The adjustment of the oil overflow valve determines the maximum oil pressure, which should for example lie 10% above the maximum expected gas pressure. Therefore, the setting of the spring loaded oil overflow valve is comparable to that of a safety valve.

Figure 2:
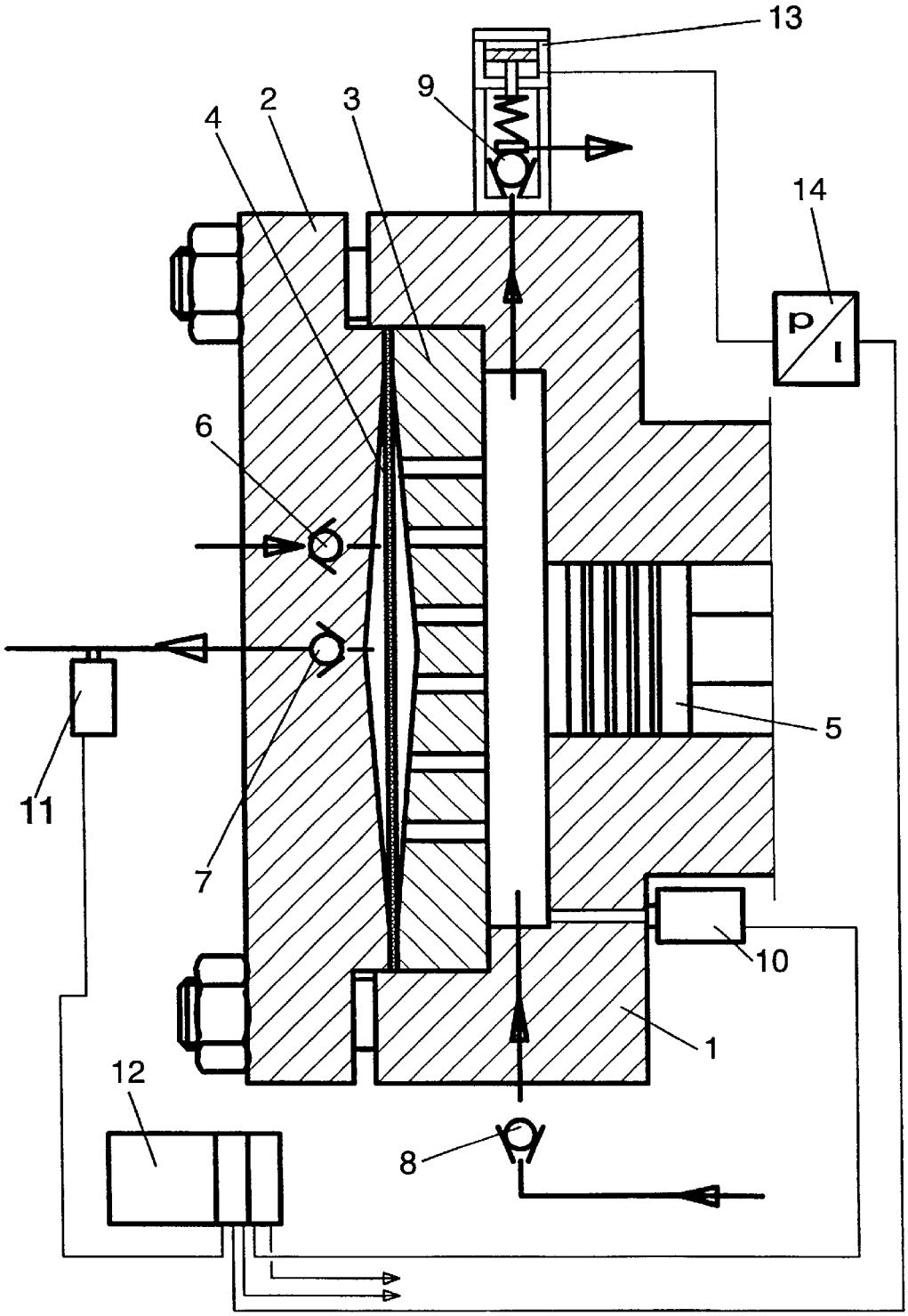
FIG. 2 shows a complete diaphragm head supplemented with the electronic pressure sensors and the associated evaluation circuit.
Figure 3:
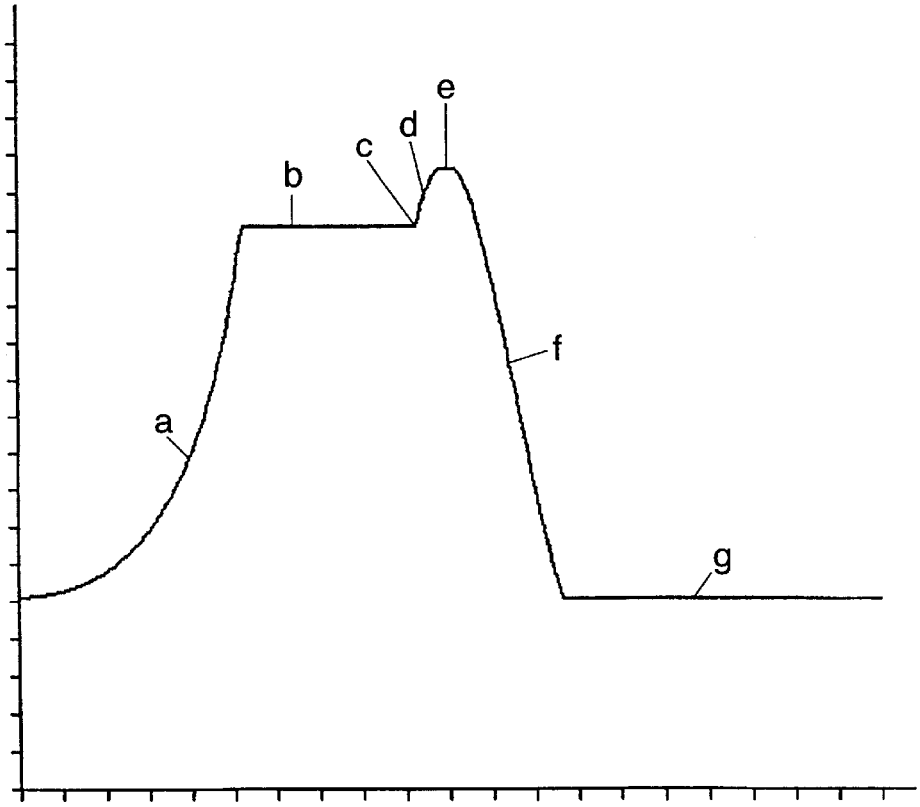
FIG. 3 shows the working diagram, as a pressure-time diagram, during one revolution.

For the control of the important gas pressure-oil pressure relationship, from here for example 10%, as seen in FIG. 2 one electronic pressure sensor (10) is arranged on the oil side and another electronic pressure sensor (11) is arranged on the gas pressure side of the diaphragm head. These sensors supply their signals to the associated evaluation circuit (12) which preferably consists of a fast PLC-unit. In the PLC-unit, by way of fast scan methods, the maximum values of the signals are determined and these are compared with the fixed relationship value. If the pregiven relationship minimum value is undershot, an alarm signal or a signal for shutting off the compressor is produced. With this method, the correct relationship between the gas pressure and the oil pressure spikes is controlled and evaluated. In connection with this, an explanation with the help of the working diagram of FIG. 3 is of service.

In this diagram a complete working cycle is illustrated. In the compression stroke the taken in gas is compressed (a). Upon the reaching of the utmost gas pressure, the compressor pressure valve opens and the gas is expelled at that end pressure (b). With the complete engagement of the diaphragm on the cover (c), there begins the additional oil pressure increase (d) with the help of the injection of the excessive amount of oil and the set pressure of the oil overflow valve (e). In the suction stroke, the rearward expansion of the gas out of the dead space and the oil amount of the head takes place (f) and thereafter transitions to the suction phase (g) upon reaching of the suction pressure.

The method for the control of the relationship between the gas pressure (b) and the maximum oil pressure (e) registers the negative effects of both a lowering of the oil pressure (e) as well as an increase of the gas pressure (b). In both cases if the pregiven minimum relationship is undershot a corresponding output signal is supplied to the alarm or to a shutdown circuit, if in the evaluation circuit two supervisory limit values are installed.

In the case of compressors which are driven with highly variable end pressures, such as appears in the filling of gas flask batteries, similarly largely variable relationships of gas pressure and oil pressure appear with the pregiven minimum relationship being constantly watched. On the other hand there occurs longer periods in which the momentary low gas pressure constantly exceeds the oil pressure associated with the maximum gas pressure. This operating mode of very high but safe gas pressure-oil pressure relationship also has certain disadvantages, even though not as great as those described for the too low relationship. In this operating condition the high pressure difference between the gas pressure and the oil pressure has a negative effect on the service life of the diaphragm. Further, the oil compressibility of the provided oil volume has a negative effect on the delivery efficiency of the compressor. That is, if the oil pressure at low gas pressure can correspondingly sink, the delivery flow of the compressor can be increased. In this case a constant gas pressure-oil pressure relationship is preferred, which is realized by a regulating circuit, in which a relief device for the oil overflow valve works as an adjusting member. In this regulating circuit function a minimum relationship is likewise supervised and the signal outputs are evaluated. This relief mechanism is then activated as soon as the adjustment member is pushed to its end position.

Figure 4:
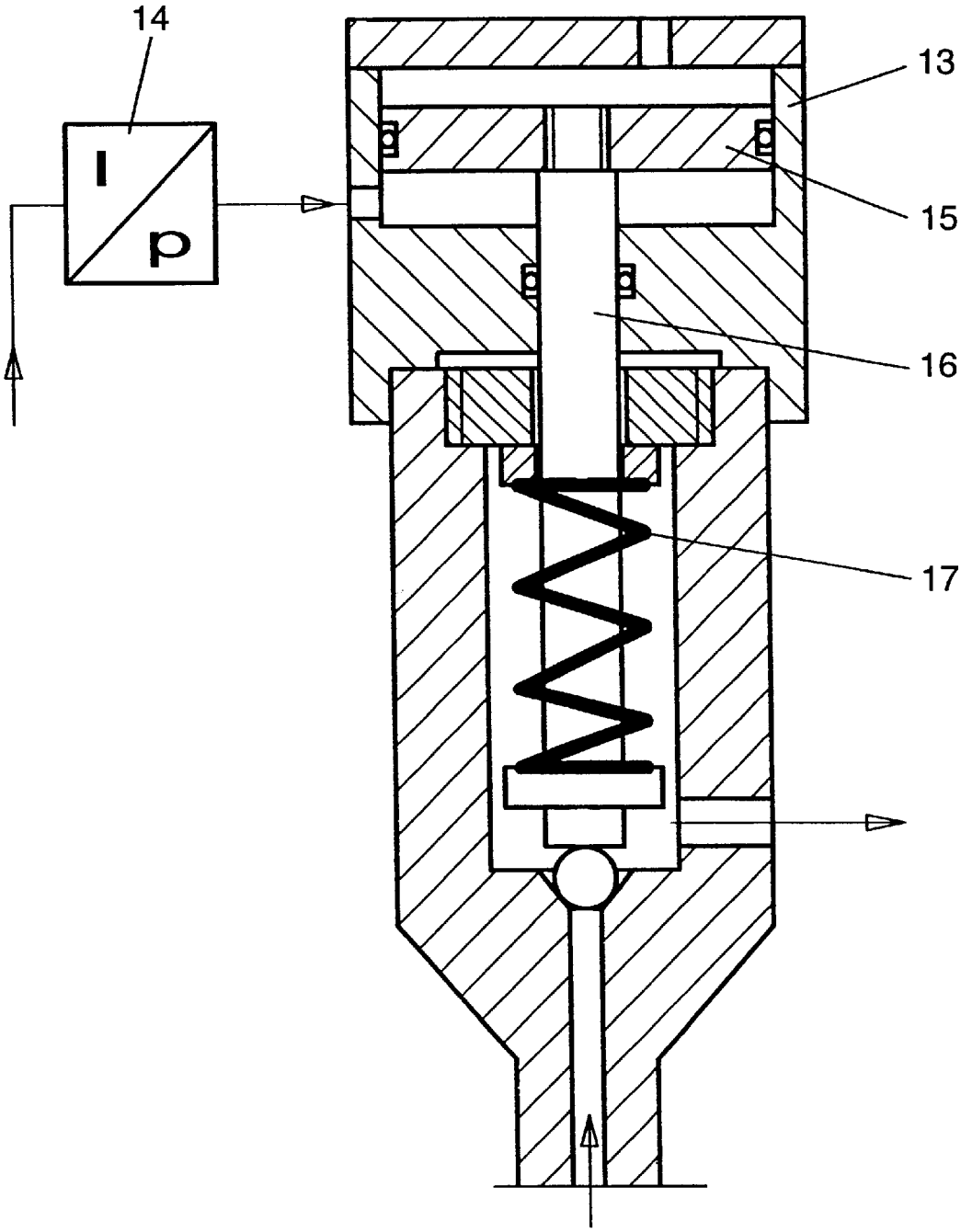
FIG. 4 shows the spring loaded oil overflow valve with the relief mechanism.

In FIG. 4 the relief mechanism (13) is illustrated along with the oil overflow valve. Associated with this is an I/P-converter (14) which converts the analog flow-adjustment value signal into a corresponding pressure signal. This works from below onto the piston or the diaphragm (15) of the relief mechanism (13) so that thereby a tension force is exerted on the valve spindle (16), with the pretensioned valve spring (17) being unloaded and the oil pressure thereby being more or less reduced. Through an exemplary preferred P/I-regulating characteristic there then takes place a relatively rapid change to the set gas pressure-oil pressure relationship.

If the set signal is provided with a null value the full effect of the spring force establishes the maximum oil pressure, which again brings the desired relationship to the maximum provided gas value. In connection with this it is also to be known that with a failure of the control air for the I/P-converter (14) the overflow valve is set to its maximum pressure and the compressor, by assuring the minimum relationship even in the case of disturbance, always remains in a safe operating area.

The safe control of the gas pressure-oil pressure relationship makes the diaphragm compressor into a construction component which fills the requirements of a completely automatic operation in every respect.

What is claimed is:

1. A method for the control and regulation of the oil pressure-gas pressure relationship of a diaphragm compressor, characterized by capturing the oil pressure-gas pressure relationship by one electronic pressure sensor on the oil side of the diaphragm head and another electronic pressure sensor in the gas pressure conductor of the gas outlet side of the diaphragm head, and with an associated electronic evaluation circuit for both of the signals, determining the relationship of the two pressures from those signals and producing an output signal upon the determination of an oil pressure-gas pressure relationship less than a given minimum relationship.

2. The method for the control and regulation of the oil pressure-gas pressure relationship of a diaphragm compressor according to claim 1, characterized by maintaining a given relationship of oil pressure and a variable gas pressure, controlled and regulated by the electronic evaluation circuit and an associated relief mechanism for an oil overflow valve controlled by the electronic evaluation circuit.

3. A method for the control and regulation of the oil pressure-gas pressure relationship of a diaphragm compressor, which compressor includes a diaphragm head dividing the diaphragm compressor into an oil side and a gas outlet side, the method comprising the steps of:

sensing the oil pressure on the oil side of the diaphragm head;

sensing the gas pressure on the gas outlet side of the diaphragm head;

determining the oil pressure-gas pressure relationship based on the respectively sensed values of the oil pressure and the gas pressure;

comparing the oil pressure-gas pressure relationship with a pre-selected oil pressure-gas pressure relationship; and producing an output signal when the determined oil pressure-gas pressure relationship is less than the pre-selected oil pressure-gas pressure relationship.

4. The method of claim 3, further comprising the steps of:

providing a first electronic pressure sensor on the oil side of the diaphragm head to sense the oil pressure, wherein the first electronic pressure sensor generates a signal of the sensed oil pressure;

providing a second electronic pressure sensor on the gas outlet side of the diaphragm head to sense the gas pressure, wherein the second electronic pressure sensor generates a signal of the sensed gas pressure; and supplying the oil pressure signal and the gas pressure signal to an electronic evaluation circuit for determining the oil pressure-gas pressure relationship.

5. The method of claim 4, further comprising the step of maintaining a predetermined relationship between the oil pressure and a variable gas pressure by using the electronic evaluation circuit, an overflow valve controlled by the electronic evaluation circuit, and a relief mechanism associated with the overflow valve.

6. The method of claim 3, further comprising the step of setting an operable maximum oil pressure in the oil side of the diaphragm head at a value greater than a predetermined maximum gas pressure in the gas outlet side of the diaphragm head.

7. The method of claim 6, further comprising the step of controlling the oil pressure in the oil side of the diaphragm head with an electronic evaluation circuit, an oil overflow valve controlled by the electronic evaluation circuit, and a relief mechanism associated with the oil overflow valve.

8. The method of claim 6, wherein the maximum oil pressure is at least 10% greater than the predetermined maximum gas pressure.

9. The method of claim 3, further comprising the step of maintaining an oil pressure in the oil side of the diaphragm head greater than a gas pressure in the gas outlet side of the diaphragm head.

10. The method of claim 9, further comprising the step of controlling the oil pressure in the oil side of the diaphragm head with an electronic evaluation circuit, an oil overflow valve controlled by the electronic evaluation circuit, and a relief mechanism associated with the oil overflow valve.

11. The method of claim 10, further comprising the step of maintaining a predetermined relationship between the oil pressure and the gas pressure.

* * * * *